United States Patent [19]

Kaüfmann et al.

[11] Patent Number: 4,592,409

[45] Date of Patent: Jun. 3, 1986

[54] STRAND GUIDE FOR MULTI-STRAND METAL CASTING APPARATUS

[75] Inventors: Robert Kaüfmann, Moers; Wilhelm Kring, Duisburg, both of Fed. Rep. of Germany

[73] Assignee: Mannesmann Aktiengesellschaft, Duesseldorf, Fed. Rep. of Germany

[21] Appl. No.: 582,131

[22] Filed: Feb. 22, 1984

Related U.S. Application Data

[63] Continuation of Ser. No. 288,484, Jul. 30, 1981, abandoned.

[30] Foreign Application Priority Data

Aug. 8, 1980 [DE] Fed. Rep. of Germany ..... 3029991

[51] Int. Cl.[4] ..... B22D 11/128

[52] U.S. Cl. ..... 164/442; 164/448

[56] References Cited

U.S. PATENT DOCUMENTS

| | | | |
|---|---|---|---|
| 3,447,591 | 6/1969 | Foldessy | 164/442 |
| 3,542,117 | 11/1970 | Lemper | 164/442 X |
| 3,548,920 | 12/1970 | Torban et al. | 164/442 X |
| 3,566,955 | 3/1971 | Krall | 164/448 |

FOREIGN PATENT DOCUMENTS

| | | | |
|---|---|---|---|
| 817637 | 7/1949 | Fed. Rep. of Germany | 164/442 |
| 1080427 | of 1954 | France | 164/442 |
| 1335289 | of 1963 | France | 164/447 |
| 2364717 | 5/1978 | France | 164/442 |
| 2447764 | of 1980 | France | 164/442 |
| 437665 | of 1967 | Switzerland | 164/448 |
| 928093 | of 1963 | United Kingdom | 164/441 |
| 213300 | of 1966 | U.S.S.R. | 164/448 |

*Primary Examiner*—Kuang Y. Lin

*Attorney, Agent, or Firm*—Mandeville and Schweitzer

[57] ABSTRACT

A strand guide for a multi-strand metal casting apparatus has a longitudinal girder of at least two individual girder sections. Each girder section is provided with a support element having rows of V-shaped supporting rollers and opposed cylindrical rollers. The rows of rollers support the metal veins. The support elements extend at right angles to the girder sections and are provided with stems which are suspended in shoe supports. The shoe supports are connected to a bearing which, itself is vertically and horizontally adjustable.

5 Claims, 4 Drawing Figures

STRAND GUIDE FOR MULTI-STRAND METAL CASTING APPARATUS

This is a continuation application of application Ser. No. 288,484, filed July 30, 1981, now abandoned.

BACKGROUND OF THE INVENTION

The present invention relates to a strand guide for multi-strand casting apparati for casting strands of metal, particularly of steel, consisting of individual sections of a longitudinal girder carrying, in each instance, supporting elements for the cast strand.

Multi-strand metal casting apparati of this type serve to economically produce strand-casting material in bar format of, for example, 80 to 150 mm cross section. The object of securing a high output of cast strand material is coupled, as much as possible, with the effort to hold down the technological expenditure for the apparatus. An increase in the number of strands would, therefore, be desirable which is, however, restrained by technical problems.

Critical difficulties in the process of multi-strand metal casting exist in preserving the distances between the strand veins which are arranged adjacently to each other. The distance between outlet pipes, which are fastened to the distributor channel, is desirably as short as possible in order to meet the difficulties inherent in the expanding distributor channel. This effort, in turn, affects the distance of the successive structural elements which, inter alia, exerts an influence on the strand guide. Consecutively shorter distances between the outlet pipes cause difficulties in the directly, adjacently, arranged strand guides, because the distances of said strand guides are determined by the predetermined distance from strand vein to strand vein in the distributor channel. Simultaneous with the aim of decreasing the distance between the individual outlet pipes, fastened to the distributor channel, is the aim of providing a space-saving design for the strand guide.

DESCRIPTION OF THE PRIOR ART

According to the state of the art (DE-OS 26 57 248 - B 22 D 11/04), separate individual strand guides are provided, in each instance, within a multi-strand apparatus. These strand guides consist of longitudinal girders arranged in pairs having supporting elements for the cast strand provided between the respective girders. The known solution does not only represent a large expenditure but also requires, particularly for multi-strand apparati with more than two strand veins, significant space which hardly corresponds with today's current metallurgical conditions. It is necessary, in designing a multi-strand casting apparatus, to take into account the so-called "metallurgical distance" of two strand veins. "Metallurgical distance" describes the distance of the individual strand veins from the point of entry of the liquid metal, i.e., the pouring point of the metal to the distributor channel or trough. In other words, the molten material flows a metallurgical distance from the pouring spout to the distributor channel, losing a portion of its retained heat, and the molten material, with temperature variations, is directed to the individual strand veins.

SUMMARY OF THE INVENTION

The object of the present invention is to create a simplified strand guide, which is suitable for use with minimal distances between strand veins and, at the same time, involve a minimum expenditure for the strand guide for multi-strand apparati having more than two strands.

The problem is solved, according to the invention, by providing, for each longitudinal section, supporting elements, in rows, for groups of two or more strand veins, extending at right angles to the longitudinal girders. Stems are fastened or secured at the exterior of the longitudinal girders, proximate to their girder ends. Of the stems so provided, at least one set is supported in a horizontally and vertically adjustable support and, if need be, the others are supported in a stationary support. The present invention advantageously provides a longitudinal girder, which may consist of a larger bar profile, or of a plurality of smaller individual profiles, or of a pipe profile, having rows of supporting elements. These rows of supporting elements are, consequently, separated from each other merely by the distance of their bearings. Interconnecting longitudinal girder sections may be adjusted without difficulties to an aligned line which fixes the strand vein. Thus, advantageously, the adjustment occurs simultaneously and precisely for all the rows of supporting elements, since they are arranged as a group at the longitudinal section. The grouping arrangement also has the advantage of regulating the strand drive machine as well as the cooling process in groups so that groups of strands with similar cooling behavior may be grouply seized.

The grouping arrangement of rows of supporting elements in one group of cast strands may be further improved in that the adjustable bearing consists of a stationary base plate with a ball-and-socket joint rotatable around a horizontal axis in the area of one end, about which end a lever plate is adjustable in a vertical plane. The lever plate is provided with holding or support shoes which, with the stems formed as projections from the girder ends, support the supporting elements.

An additional provision is that the lever plate, which is pivotal at one end in a vertical plane, is designed with an adjustable buffer, supported against the base plate, at the other end.

A particularly advantageous aspect of the configuration of the rows of supporting elements, and thus the provision of an efficient strand guide, resides also in the fact that the rows of supporting elements consist of supporting rollers having a V-shaped profile which support the strand cross section and additional supporting rollers of cylindrical cross section which face the rows of supporting elements. This type of strand guide, therefore, shows, in the continuous-casting cast-iron mold, an arrangement of the cast metal cross section having the corners of a polygonal, for example, a square casting cross section, being arranged facing one another. Also the individual casting strands are arranged to rest, with their corners bearing against the respective supporting rollers and additional supporting rollers. This latter idea is itself an independent invention in that the one-sided arrangement of supporting rollers having a V-shaped profile constitutes a strand guide providing support in two directions so that the additional supporting rollers having a cylindrical profile facing the V-shaped supporting rollers merely serve a bracket-function. In this respect it is also significant that the strand surfaces may be more favorably exposed to cooling means than previously was the case. A further advantage in the diamond-like arrangement of the strand cross sections results in it now being possible to better use the stress capacity of the strand mold in the upper area of the strand-casting apparatus.

An additional provision is made in that the rows of supporting elements having the cylindrical rollers facing the row of supporting elements with the V-shaped profile supporting rollers are adjustable in their entirety with respect to one another.

An exemplary embodiment of the invention is illustrated in the drawing and detailed as follows:

DETAILED DESCRIPTION OF THE INVENTION

Figure 1:
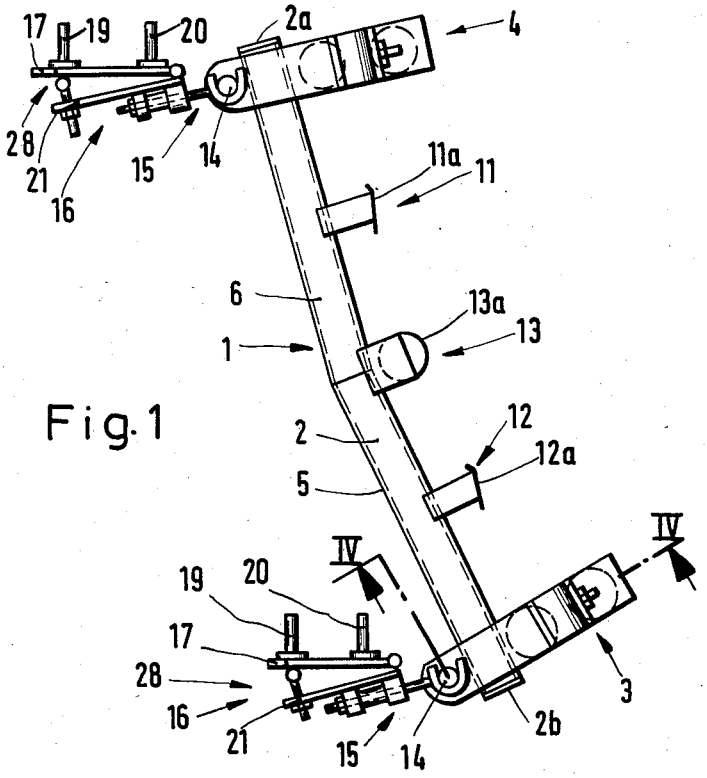
FIG. 1 is a side elevational view of the strand guide, according to the present invention, in a section of a longitudinal girder.

The strand guide for the multi-strand apparatus shown in FIG. 1 is formed of a plurality of individual longitudinal girder sections 1, of which only one is illustrated. Each of the longitudinal girder sections 1 is, as far as the longitudinal girder 2 is concerned, similarly designed. The supporting elements are variably designed, as desired. Supporting element rows 3,4,11,12 and 13 are provided in the exemplary embodiment. The longitudinal girder 2 consists of welded-together pipe pieces 5 and 6 of which the interior space 7 (See FIG. 4) may conveniently be used with other pipes for providing a cooling medium to the strand guide. Alternatively, the interior space 7 of the pipe pieces 5 and 6 can provide for the inlet and/or the outlet of a cooling means for the cast strand. It is also possible to thread electrical conduits in the interior space 7 so that, in this manner, the interior space 7 serves as a protected space from the outside harsh environment. On the other hand, the longitudinal girder 2 may also consist of roller profiles which are connected by bars which, however, nevertheless still form a longitudinal girder 2 in the shape of a ridge.

Figure 4:
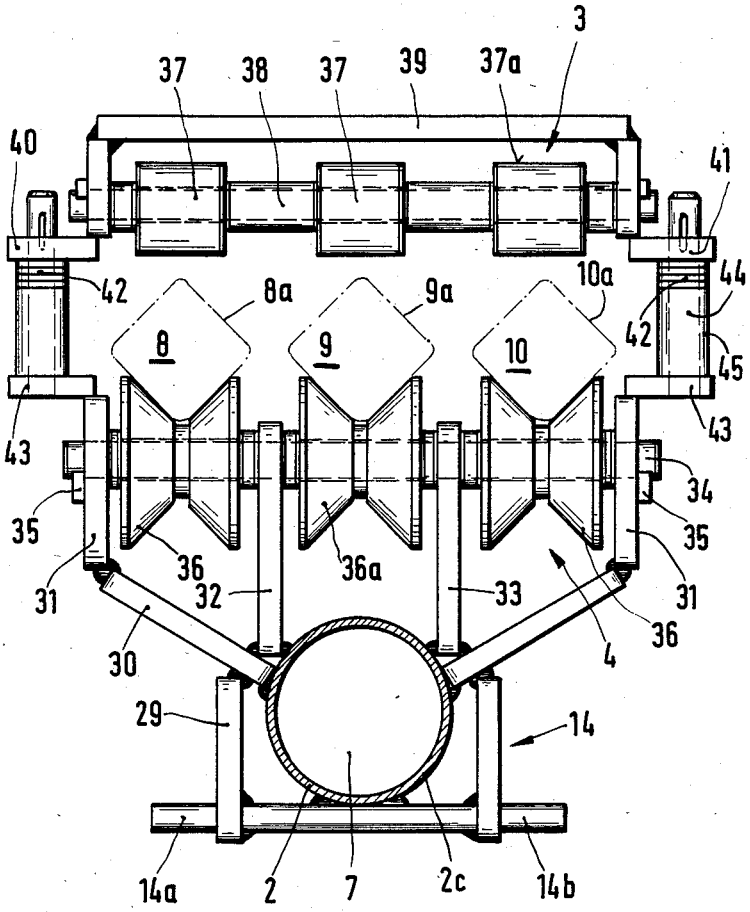
FIG. 4 is a cross sectional view of the strand guide, according to the present invention, taken along lines IV—IV of FIG. 1.

The illustrated exemplary embodiment of the present invention shows a group of three strand veins 8,9,10 (FIG. 4). Four of such groups, for example, when multiple arranged next to each other may form a 12-strand apparatus.

Each group of strand veins (in the example herein, three veins are used) is provided with at least two supporting elements 3 and 4. The supporting rollers, for the individual strand veins, of the supporting elements 3 and 4 are aligned such that the rollers themselves form a row of rollers. In addition, vein supporting elements 11 and 12 may be provided in between the location of the supporting elements 3 and 4. Here, again, the supporting surfaces of the elements 3, 4, 11 and 12, for each vein strand, are in a row, i.e., in general alignment. Elements 11 and 12 are provided with rigid supporting elements 11*a* and 12*a* which may be in the form of a flat planar surface. Alternatively, a supporting element 13 having a single supporting roller 13*a* for each strand vein, serving to support only one side, i.e., the underside, of the strand veins, may be provided between supporting elements 3 and 4. The rollers 13*a* are also in general alignment with the corresponding vein supporting elements of elements 3 and 4. Stems 14 are fastened or attached to the outside of the longitudinal girder 2*c* at the longitudinal-girder ends 2*a* and 2*b*. The stems 14 rest in bearings 15. The exemplary embodiment shows both bearings 15 being provided with adjusting devices 16.

Figure 3:
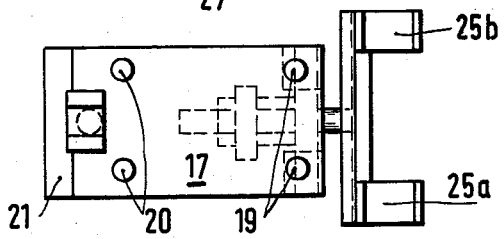
FIG. 3 is a top plan view of the adjusting device shown in FIG. 2.

The adjusting devices 16 form part of the bearing 15 and are themselves fastened to a structural support element of the strand-casting apparatus, not illustrated. The adjustable bearing 15 consists of a stationary base plate 17 having a ball-and-socket joint 18 fastened to its end 17*a*. The base plate 17 is bolted, by means of screws 19 and 20, to the structural support element, not illustrated, of the strand-casting apparatus. The lever plate 21 is pivotally arranged, in a vertical plane, around the horizontal axis 22 of the ball-and-socket joint 18. Bearing blocks 23*a* and 23*b*, provided with bore holes passing therethrough, are secured to the lever 21. A spindle 24 is arranged inside the bore holes of the bearing blocks 23*a* and 23*b* and extends in the longitudinal direction. Support shoes 25*a* and 25*b* are fastened at the tip of the spindle 24 (See FIG. 3), with the respective stems 14 reaching inside and contained by the support shoes. In this case, the stems 14 consist of projections 14*a* and 14*b* (See FIG. 4). Nuts 26 and 27 serve to adjustably fix the spindle 24.

Figure 2:
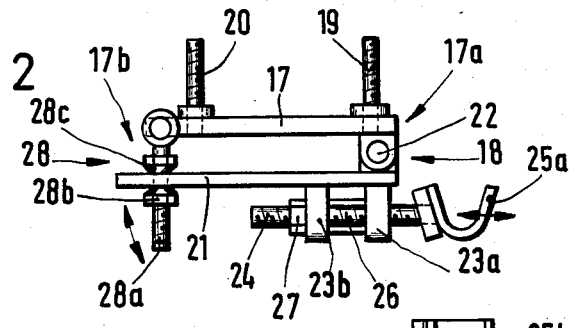
FIG. 2 is an enlarged representation of a side elevational view of the adjusting device for a longitudinal section, also according to the present invention.

At the other end 17*b* of the base plate 17, the lever plate 21 carries an adjustable buffer 28, consisting of adjusting screw 28*a* and adjusting nut 28*b*, as well as check nut 28*c* (See FIG. 2).

Besides the stem 14, supports 29, 30, and 31 are mounted to the longitudinal girder 2 (See FIG. 4) which, together with further supports 32 and 33, and the axis 34 are axially secured by means of wedges 35 and which, together with the support rollers 36 having a V-profile 36*a*, form the row of supporting element row 4. The pivotally arranged supporting rollers 36 having the V-shaped profile 36*a*, support the cast strand cross section 8*a*, 9*a*, 10*a* from two sides so that the cast strands, if only because of the supporting rollers 36, are guided and supported in at least two directions. The additional supporting rollers 37 are, in the illustrated embodiment, designed with cylindrical cross sections 37*a* to merely compensate for the rigidity in the cast strand arc, which occurs in arcuately shaped apparati. In the case of a strictly vertically arranged apparati the additional supporting rollers 37*a* hold the cast strands against the V-shaped profile 36*a* of the supporting rollers 36.

The additional supporting rollers 37 form the supporting-element row 3 and are pivotally arranged on an axis 38, which itself is supported in the cross bar 39. The cross bar 39 rests, with the base plates 40 and 41 on the shims 42. The shims 42 serve to adjust the distance between the supporting rollers 36 and the additional supporting rollers 37. Base plates 43 are mounted to the supports 31 and with spacer bolts 44 and spacer sleeve, 45, provide the mentioned adjustability between the supporting rollers 36 and the additional supporting rollers 37. The cross bar 39 is held in the spacer bolt 44 by means of keying devices.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. In a combination device which includes a strand guide and a multi-strand metal casting apparatus comprising:

(a) a single longitudinal girder comprising at least two individual girder sections joined, lengthwise, end-to-end, said longitudinal girder being supported by said metal casting apparatus;

(b) each of said girder sections being provided with at least one multi-strand support element for the individual cast metal strands;

(c) said support element having aligned individual strand vein support elements extending substantially perpendicularly to said girder sections;

(d) said single longitudinal girder being positioned below and lying between the outside ends of said multi-strand support element;

(e) outwardly projecting stems secured to at least one of said multi-strand support element;

(f) at least one bearing secured to said casting apparatus;

(g) said stems being supported in said bearings; and (h) said bearings being variably adjustable both in horizontal and vertical directions, to thereby variably adjust the position of said longitudinal girder.

2. The combination device claimed in claim 1 wherein said bearing which is adjustable both in horizontal and vertical direction comprises:

(a) a stationary base plate secured to said casting apparatus;

(b) said base plate having, at one end, a ball-and-socket type joint having a horizontal axis;

(c) a lever plate being pivotally adjustable about said horizontal axis of said ball-and-socket joint; and (d) said lever plate having support shoes adjustable in the horizontal direction for supporting said stems of said multi-strand support element.

3. The combination device as claimed in claim 2 wherein:

(a) said lever plate is provided, at the end opposite the end having said ball-and-socket type joint, with a vertically adjustable buffer; and (b) said buffer is supported against said base plate.

4. The combination device as claimed in claim 1 wherein said aligned strand vein support elements comprise:

(a) supporting rollers having a V-shaped profile for underneath supporting of the metal strand veins; and (b) additional supporting rollers on top of said metal strand veins of cylindrical cross section opposing said underneath supporting rollers.

5. The combination device as claimed in claim 4 wherein:

(a) said additional supporting rollers are relatively adjustable with respect to the distance between them and said underneath supporting rollers.

* * * * *